US006007389A

United States Patent [19]

Weber

[11] Patent Number: 6,007,389

[45] Date of Patent: Dec. 28, 1999

[54] DUAL-BEAM GROUND CONTACTS HAVING A REALIGNMENT TWIST FOR GANG INSERTION INTO AN INSULATOR HOUSING

[75] Inventor: Dale A. Weber, Mission Viejo, Calif.

[73] Assignee: Thomas & Betts International, Inc., Sparks, Nev.

[21] Appl. No.: 09/148,951

[22] Filed: Sep. 8, 1998

Related U.S. Application Data

[60] Provisional application No. 60/058,303, Sep. 9, 1997.

[51] Int. Cl.[6] ..... H01R 11/22

[52] U.S. Cl. ..... 439/857; 439/636

[58] Field of Search ..... 439/857, 856, 439/60, 636

[56] References Cited

U.S. PATENT DOCUMENTS

| | | | |
|---|---|---|---|
| 3,818,423 | 6/1974 | McDonough | 439/857 |
| 4,045,868 | 9/1977 | Ammon et al. | 29/629 |
| 4,075,759 | 2/1978 | Sochor | 29/629 |
| 4,220,393 | 9/1980 | Ammon et al. | 339/221 |
| 4,324,451 | 4/1982 | Ammon et al. | 339/176 |
| 4,743,208 | 5/1988 | Weisenburger | 439/398 |
| 5,013,264 | 5/1991 | Tondreault | 439/636 |
| 5,085,601 | 2/1992 | Buchter et al. | 439/660 |
| 5,344,343 | 9/1994 | Seidler | 439/876 |
| 5,358,413 | 10/1994 | Daly et al. | 439/79 |
| 5,785,556 | 7/1998 | Pratt et al. | 439/637 |

*Primary Examiner*—Neil Abrams
*Assistant Examiner*—Javaid Nasri
*Attorney, Agent, or Firm*—Brian S. Welborn

[57] ABSTRACT

A card edge type electrical connector including dual-beam ground contacts each having splayed pre-loaded tips and a realignment twist enabling a plurality of such contacts to be gang inserted into the insulator housing of the connector. To adjust the pitch of the pre-loaded tips, a predetermined twist is added to the bottom of the contacts during the stamping operation which re-aligns the tips with the correct contact receiving apertures. The re-alignment twist disappears once the contact(s) are fully seated in the insulator housing, thus allowing the pre-loaded tips to reach their ultimate position within the insulator housing relative other adjacent contacts.

5 Claims, 8 Drawing Sheets

DUAL-BEAM GROUND CONTACTS HAVING A REALIGNMENT TWIST FOR GANG INSERTION INTO AN INSULATOR HOUSING

This Application claims the benefit of U.S. Provisional Application Ser. No. 60/058,303 filed Sep. 9, 1997.

BACKGROUND

The present invention relates generally to the art of electrical connectors and, more particularly, to a "card edge" electrical connector for a printed circuit board. In even greater particularity, the present invention relates to dual-beam ground contacts having a realignment twist for gang insertion into the insulator housing of a card edge electrical connector.

Historically, prior art electrical connectors have been assembled by very tightly press fitting or molding contacts into receiving blocks of insulative material which form structural members to support the contacts and hold them rigidly within the insulative body. The prior art connector having contacts rigidly fixed within the insulator are then mounted by bolting the insulator to a pair of spaced parallel rails, or by dropping the contact tails into holes in a mounting substrate and soldering them in place. The prior art techniques for assembly of the aforesaid connectors are relatively slow because of the time required to rigidly mount each individual contact into its receiving sleeve within the insulator. Certain prior art connectors have overcome this problem by providing for simultaneous insertion of rows of contacts held together by carrier strips into receiving sleeves which hold them in position within the insulator housing.

A popular type of electrical connector which is used widely in the electronic industry is called a "card edge" connector. A card edge connector receives a printed circuit board having a mating edge and a plurality of contact pads adjacent the edge. Such card edge connectors typically have an elongate insulator housing defining an elongate receptacle or slot for receiving the mating edge of the printed circuit board. A plurality of contacts are spaced along one or both sides of the slot for engaging the contact pads adjacent the mating edge of the board. In many applications, such card edge connectors are mounted on a second printed circuit board. The mating edge board or card is commonly called a "daughter" board, and the board to which the connector is mounted commonly is called the "mother" board.

One of the problems with card edge connectors of the character described above, however, centers around the ever-increasing demands for high density electronic circuitry. The contacts of such a connector are mounted in a housing fabricated of dielectric material such as plastic or the like. Not only are the contacts becoming ever-increasingly miniaturized, but their number or density within the housing is becoming greater and greater, thus significantly increasing the likelihood of short circuiting between the respective contacts. In order to solve the potential problem of short circuiting, separate sleeves may be designed into the housing to partition the contacts so that they are electrically isolated from one another. This technique is very difficult and cost prohibitive because of the miniaturized size and number of contacts. A more viable solution has been to fashion or form the contacts into specific shapes to avoid shorting or being shorted by other contacts. An example of this technique is to pre-load or bend the tip of certain contacts to avoid other non-preloaded contacts within the insulator housing.

However, even pre-loading the tips of contacts to avoid short-circuiting suffers from the standpoint of assembly. While a typical card edge connector utilizes a plurality of contacts formed out of sheet material on a common carrier strip so that they can be simultaneously inserted into the insulator housing, the above described technique of pre-loading tends to offset or mis-align the tips of the contacts with the spacing or pitch of the correct insulator housing slots or cavities, thus preventing simultaneous gang insertion of the contacts. As a result, the tips of pre-loaded contacts typically have to be inserted into the insulator one-by-one.

It is, therefore, desirous to provide electrical contacts which may be manufactured in quantity from sheet material on a carrier strip having pre-loaded tips, yet may be gang inserted into an insulator housing.

SUMMARY

The present invention addresses the above needs by providing dual-beam ground contacts each having a realignment twist enabling a plurality of contacts on a common carrier strip to be gang inserted into the insulator housing of a card edge electrical connector. To adjust the pitch of the pre-loaded tips, a predetermined twist is added to the bottom or bottoming portion of the contacts during the stamping operation which re-aligns the tips with the correct contact receiving apertures. This re-alignment twist disappears once the contact(s) are fully seated in the insulator housing.

BRIEF DESCRIPTION OF THE DRAWINGS

The features of this invention which are believed to be novel are set forth with particularity in the appended claims. The invention, together with its objects and advantages thereof, may be best understood by reference to the following detailed description taken in conjunction with the accompanying drawings in which like reference numerals identify like elements in the figures and in which:

DETAILED DESCRIPTION

Figure 1:
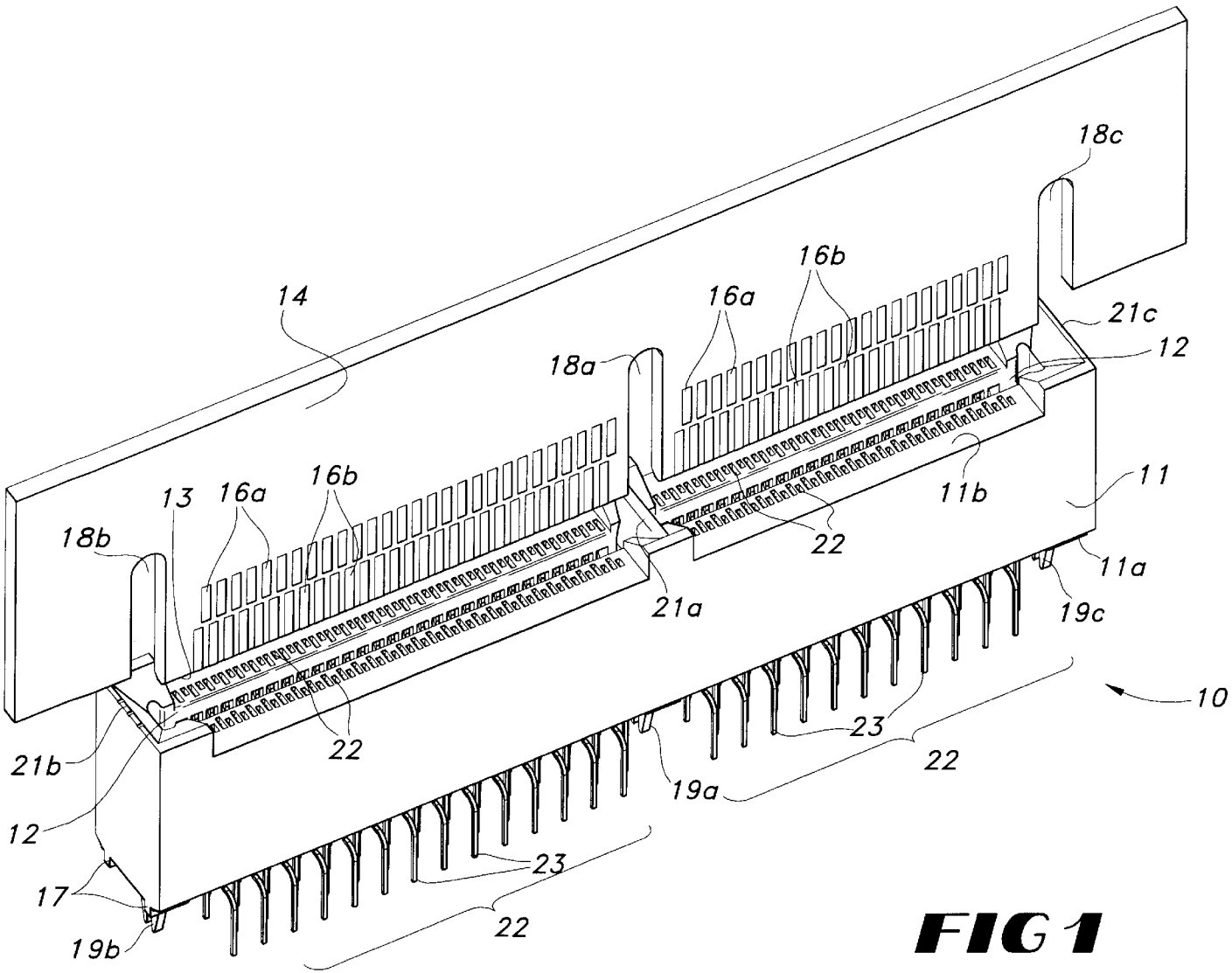
FIG. 1 is a top perspective view of a representative card edge electrical connector for incorporating electrical contacts fabricated according to the invention, in conjunction with a depiction of a printed circuit board insertable into the connector.
Figure 2:
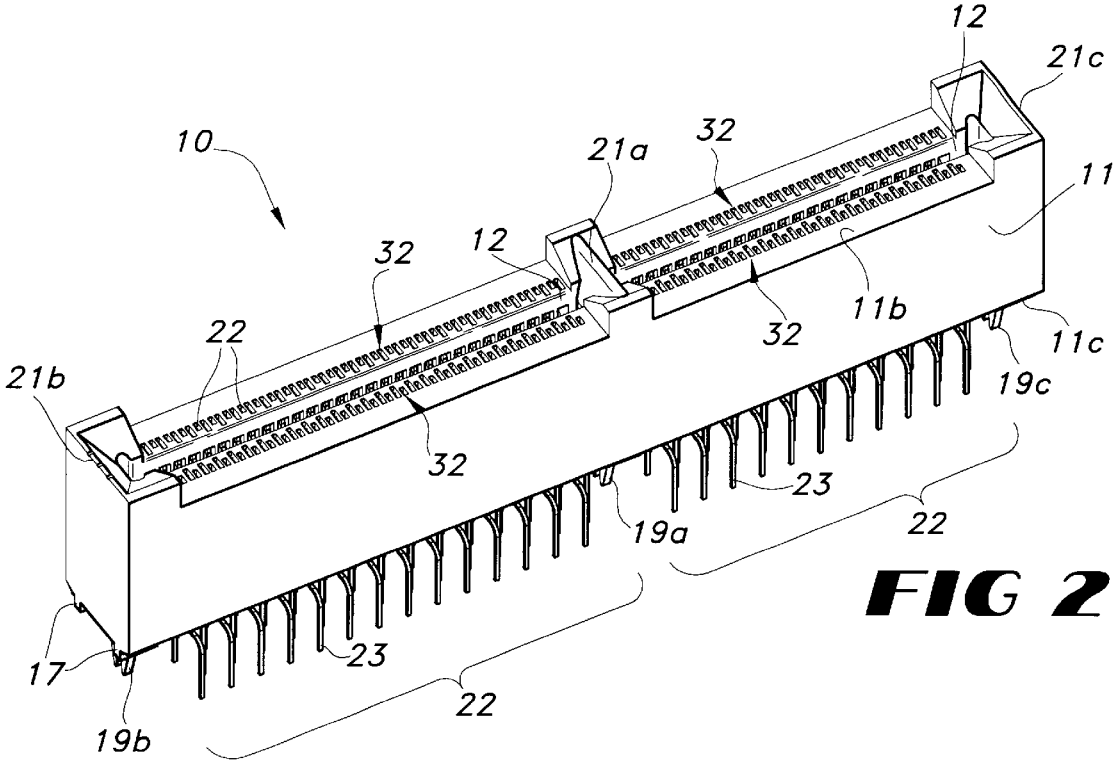
FIG. 2 is another top perspective view of the electrical connector of FIG. 1 shown without the depiction of the printed circuit board.

Referring to the drawings for a clearer understanding of the present invention, a representative elongated electrical connector of the card edge type, generally designated by the reference numeral 10, is illustrated throughout the respective views. Connector 10 preferably includes a unitarily molded, elongated insulator housing 11 constructed from any conventional insulative material known in the art. Housing 11 defines a board-mounting or terminating face 11*a* and a board-receiving face 11*b*. The board-receiving face 11*b* includes an elongate receptacle or card slot 12 for receiving a mating edge 13 of a printed circuit board 14. A plurality of contacts 22 (described hereinafter) are spaced along both sides of slot 12 for engaging contact pads 16*a* and 16*b* adjacent mating edge 13 on both sides of printed circuit board 14. As shown, contact pads 16*a* and 16*b* are in two rows, with the row of contact pads 16*b* being closer to edge 13 than the row of contact pads 16*a*. Each of the rows 16*a* and 16*b* is generally parallel to mating edge 13. A polarizing rib 21*a* which spans slot 12 and two polarizing shoulders 21*b* and 21*c* formed at each end of housing 11 are included for insertion into corresponding polarizing notches 18*a*, 18*b* and 18*c* in edge 13 of the printed circuit board 14 to ensure the board in properly oriented endwise within the slot 12 relative to the elongate connector 10.

In many applications, card edge connectors, such as connector 10, are mounted on a second printed circuit board (not shown). The mating circuit board 14 is commonly called the "daughter" board, and the second printed circuit board to which the connector 10 is mounted is commonly called the "mother" board. Connector 10 is preferably of this type and includes three boardlocks 19*a*, 19*b*, 19*c* for insertion into appropriate mounting holes in the mother board. A plurality of standoffs 17 project downwardly from board-mounting face 11*a* of housing 11 a predetermined distance in order to space the housing 11 from the mother board upon placement thereon.

Figure 3:
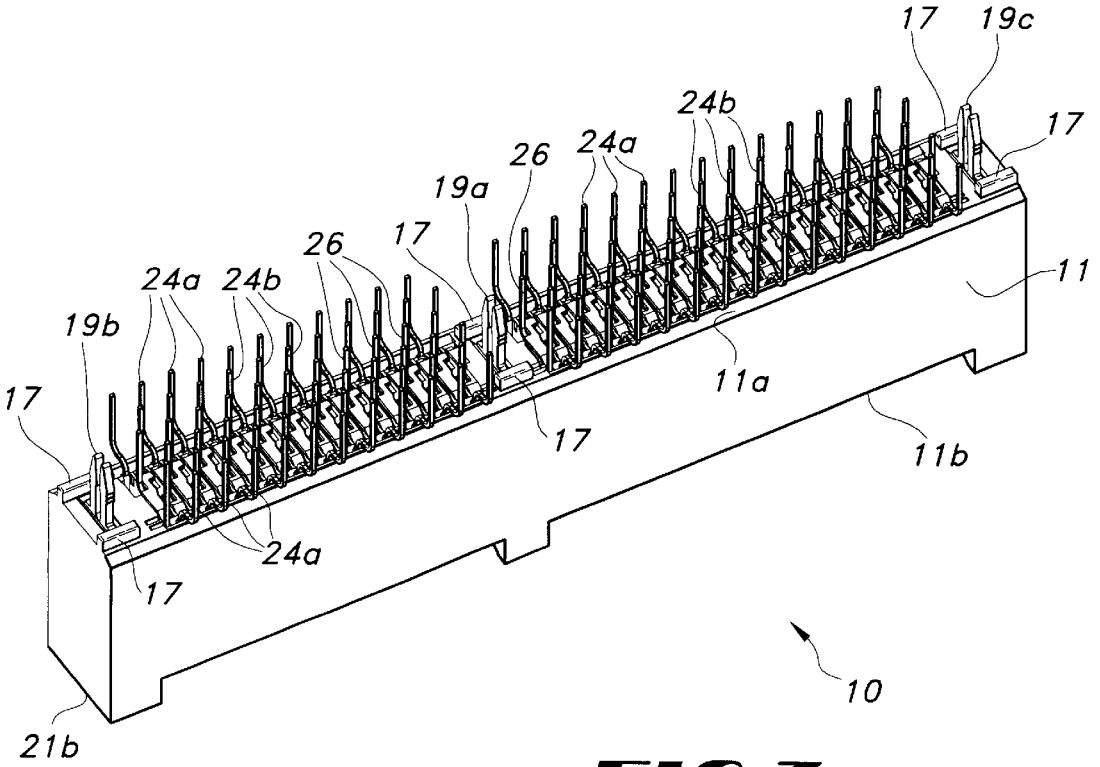
FIG. 3 is a bottom perspective view of the electrical connector shown in FIG. 1.
Figure 4:
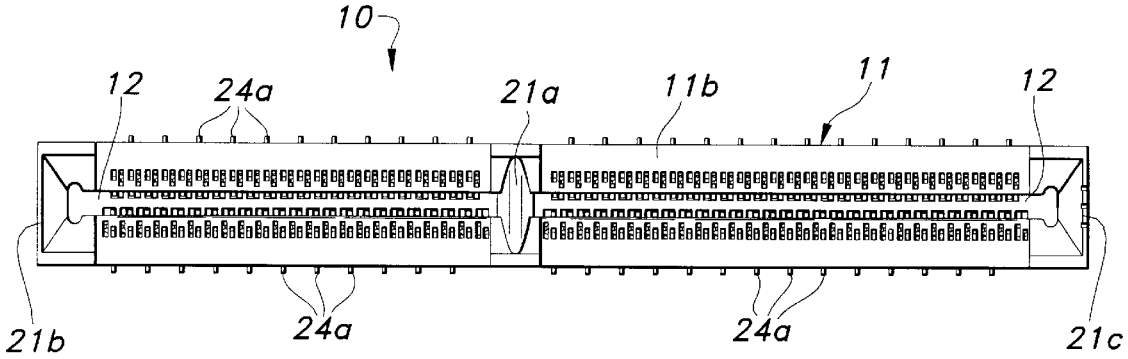
FIG. 4 is a top plan view of the electrical connector shown in FIG. 1.
Figure 5:
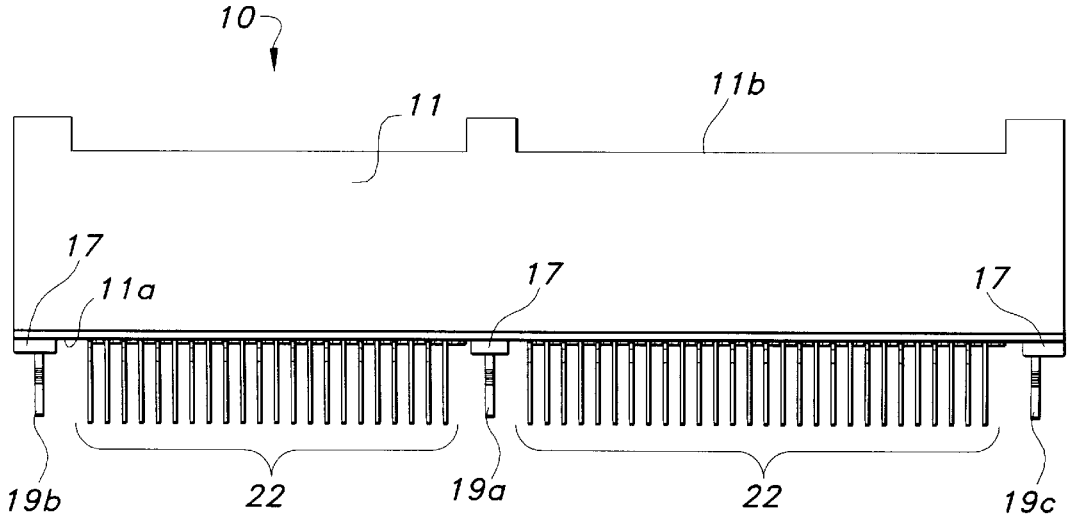
FIG. 5 is a front elevational view of the electrical connector shown in FIG. 1.
Figure 6:
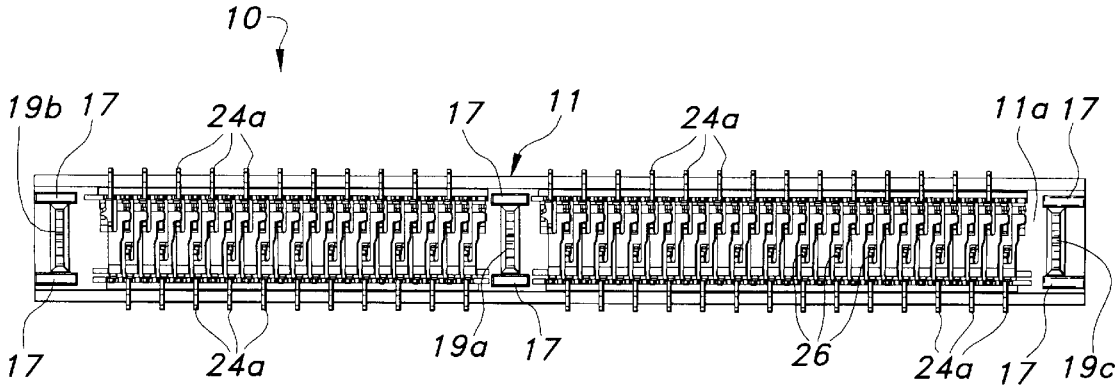
FIG. 6 is a bottom plan view of the electrical connector shown in FIG. 1.
Figure 7:
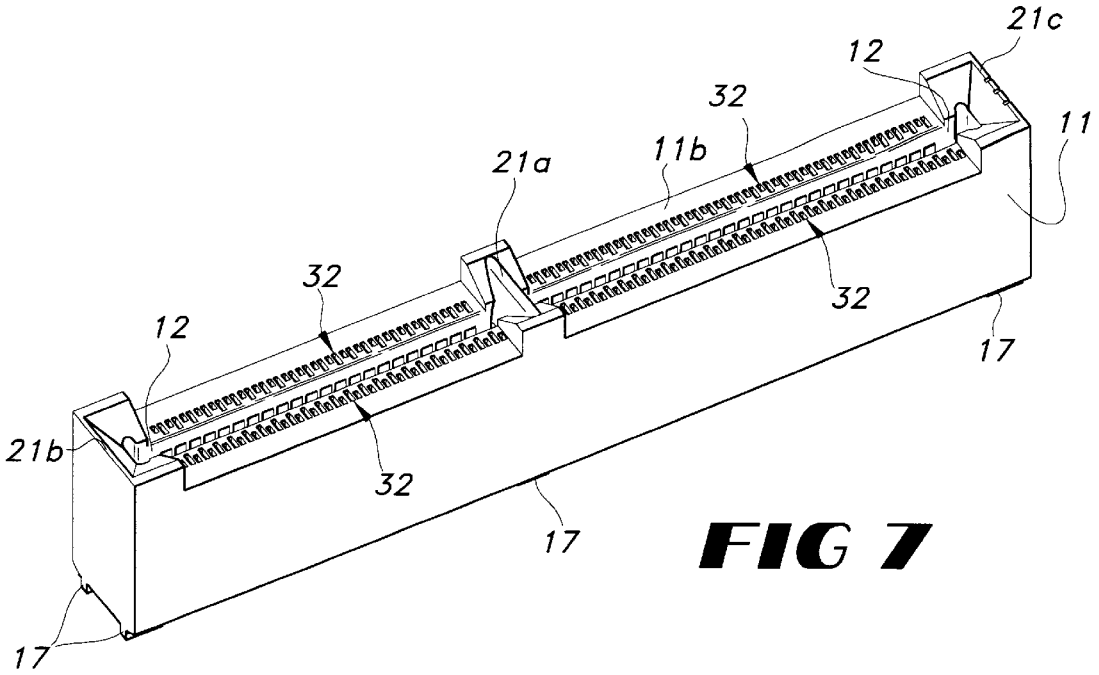
FIG. 7 is a top perspective view of the insulator housing of the electrical connector shown in FIG. 1.
Figure 8:
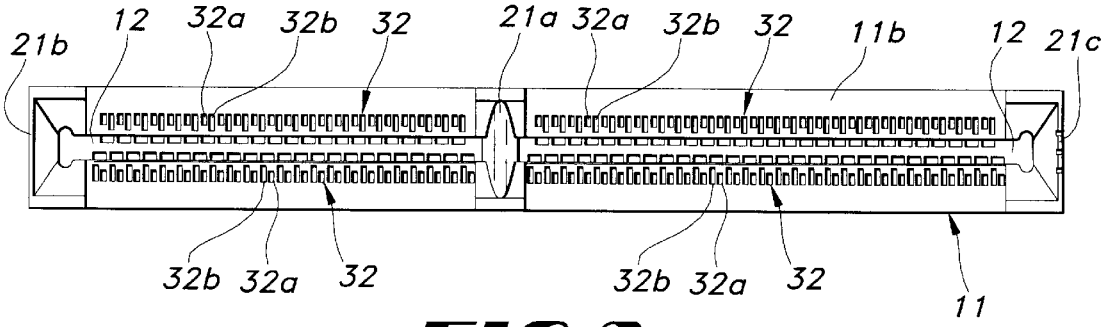
FIG. 8 is a top plan view of the insulator housing shown in FIG. 7.
Figure 9:
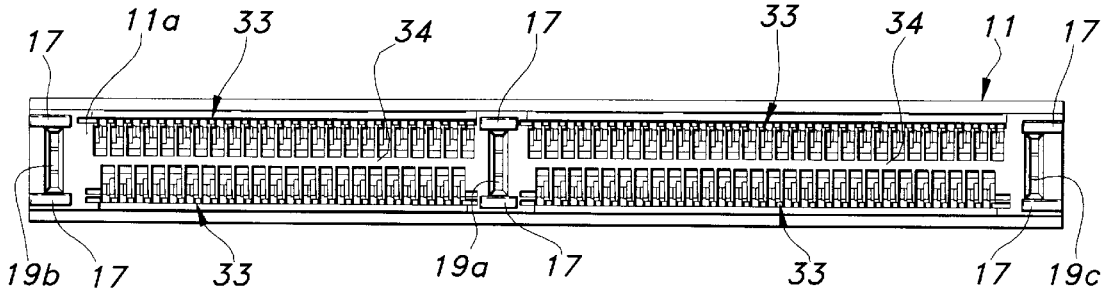
FIG. 9 is a bottom plan view of the insulator housing shown in FIG. 7.
Figure 21:
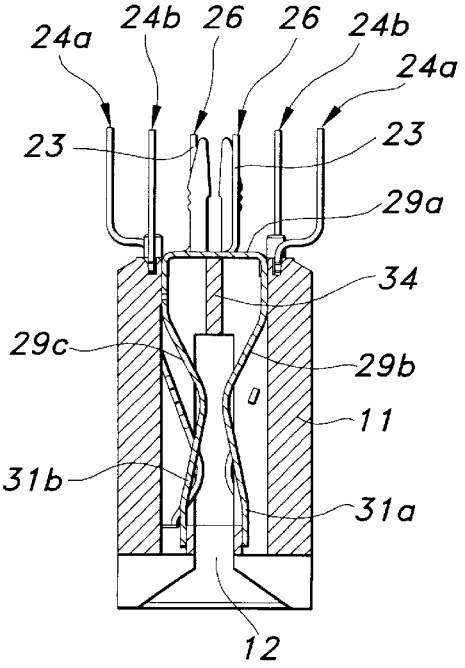
FIG. 21 is a cross-sectional view of the electrical connector of FIG. 1 showing both signal and ground contacts fully seated within the insulator housing.
Figure 20:
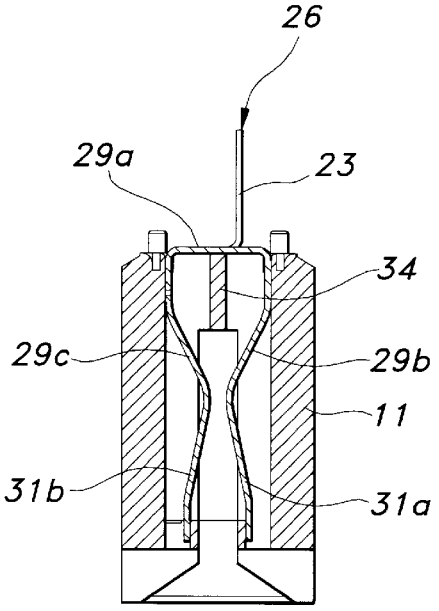
FIG. 20 is a cross-sectional view of the electrical connector of FIG. 19 showing one of the dual-beam ground contacts fully seated in the insulator housing.

As stated above, connector 10 generally includes a plurality of contacts 22 functionally positioned within housing 11 along each side of slot 12 so as to operatively engage the contact pads 16*a* and 16*b* on both sides of the daughter board 14. All of the contacts 22 include tail portions 23 which project downwardly a predetermined distance away from board-mounting face 11*a* for operatively engaging the mother board. As best shown in FIGS. 3, 6 and 21, the plurality of contacts 22 preferably comprise a first series of simple cantilevered beam signal contacts 24 and a second series of dual-beam ground contacts 26. Signal contacts 24 are of the conventional type found in card edge connectors and may include first and second predetermined shapes as generally shown at 24*a* and 24*b*, respectively.

Figure 10:
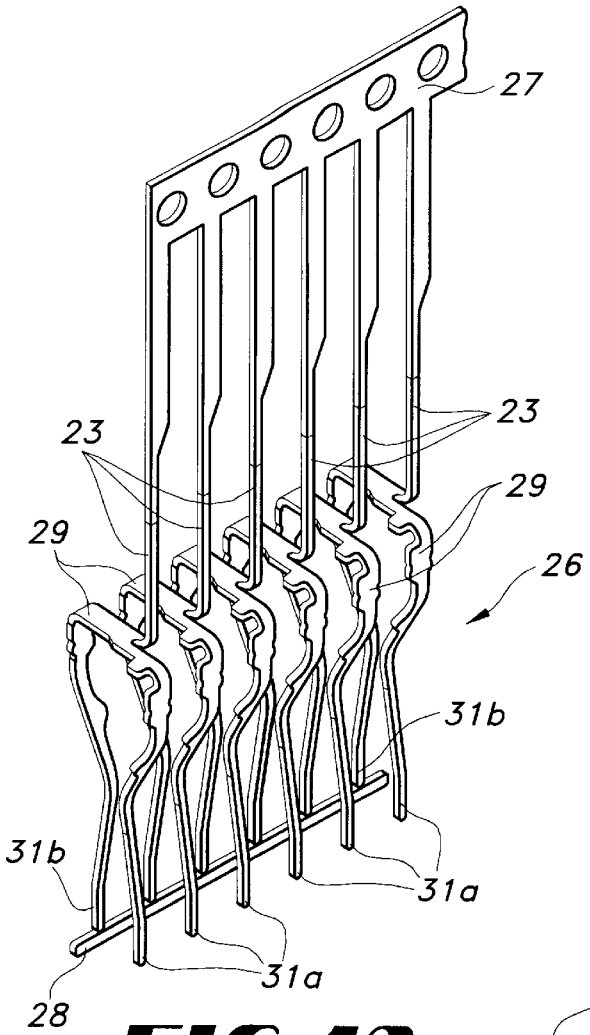
FIG. 10 is a fragmented perspective view of an elongate strip of dual-beam electrical contacts still interconnected by a main carrier strip and a tip carrier strip.
Figure 18:
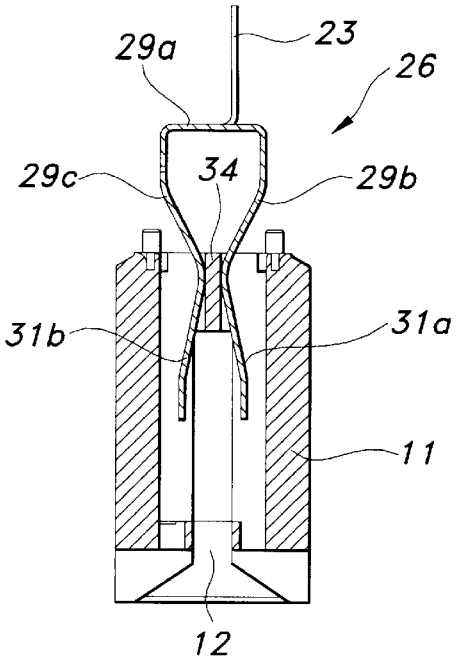
FIG. 18 is a cross-sectional view of the electrical connector of FIG. 17 showing only one of the dual-beam electrical contacts partially inserted into the insulator housing.

Referring to FIG. 10, a plurality of dual-beam ground contacts 26 are preferably stamped, formed and oriented in a conventional manner out of known sheet material into an elongate strip of dual-beam electrical contacts interconnected by a main carrier strip 27 and a tip carrier strip 28. The contacts 26, as shown, each include a tail portion 23, a generally "U" shaped collar portion 29 to which one end of tail portion 23 is attached, and two diametrically opposed tips 31*a* and 31*b* which diverge from one another at the attachment points to collar portion 29. The opposite end of each tail portion 23 is attached to and lies in the same plane as carrier strip 27. The "U" shaped collar portion 29 and tips 31*a* and 31*b* are formed and oriented, however, so as to lie in a plane generally perpendicular to the plane of carrier strip 27. Tip carrier strip 28 may be attached to tips 31*a* or 31*b*. Generally speaking, before insertion into housing 11, carrier strip 28 is removed from the contacts 26. Once the contacts are fully seated in housing 11, carrier strip 27 is removed by flexing the strip in relation to the contacts.

Figure 13:
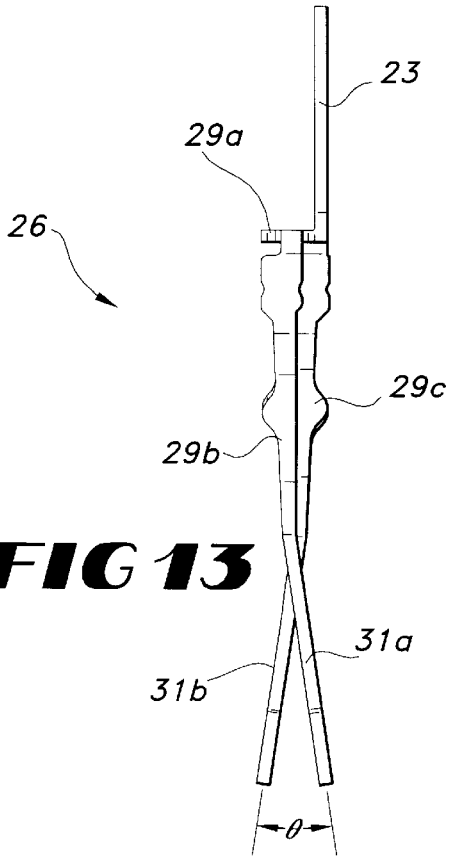
FIG. 13 is a side elevational view of the dual-beam electrical contact of FIG. 11 most clearly showing the splay angle θ between the contact tips.
Figure 14:
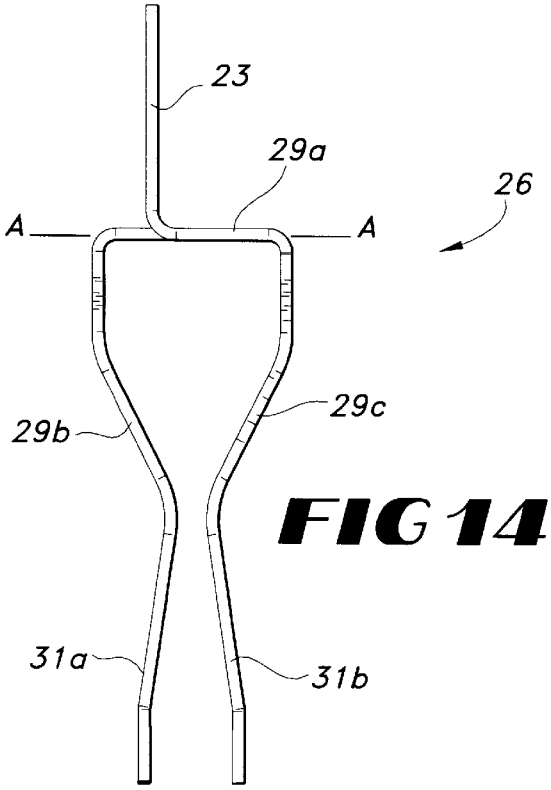
FIG. 14 is a front elevational view of the dual-beam electrical contact of FIG. 11.

Referring to FIGS. 11–14, the generally "U" shaped collar portion 29 of contact 26 includes a bottom or bottoming portion 29*a* which has a longitudinal axis, labeled as A—A in FIG. 14, substantially perpendicular to the plane of carrier strip 27. Portion 29 further includes two diametrically opposed portions 29*b* and 29*c* which project downwardly from portion 29*a* and converge toward one another whereupon they are attached to tips 31*a* and 31*b*, respectively. Furthermore, as best illustrated in FIG. 13, contact tips 31*a* and 31*b* are slightly splayed to pre-load the tips before insertion into housing 11, which assists in preventing short-circuiting with other contacts in the housing. Therefore, the splay angle between the tips, generally designated as θ, is dependent upon the design of the contact receiving sleeves or cavities within housing 11 and the proximity of the tips 31*a* and 31*b* to other contacts 24 within housing 11, which for purposes of the present invention are known in the art card edge connectors. Also, for illustrative purposes only, the contacts 26 shown in FIGS. 11–14 do not include a re-alignment twist angle α.

FIGS. 7–9, 17 and 19 best illustrate housing 11. Housing 11 has two rows of contact tip seating apertures 32 extending through the board-receiving face 11*b* for receiving the tips of contacts 24 and 26 once seated in housing 11. The rows extend generally parallel to the longitudinal axis of the housing 11, one row on each of opposite sides of card slot 12. Each row includes an alternating series of differently shaped first and second tip seating apertures 32*a* and 32*b*. Similarly, housing 11 has two rows of contact receiving apertures 33 extending through the board-mounting face 11*a* for receiving the tips of the ground contacts 26 during bottom loading into housing 11. Even though these rows extend likewise generally parallel to the longitudinal axis of the housing 11, the apertures 33 are separated or divided by a center bar 34 formed in board mounting face 11*a*.

Figure 17:
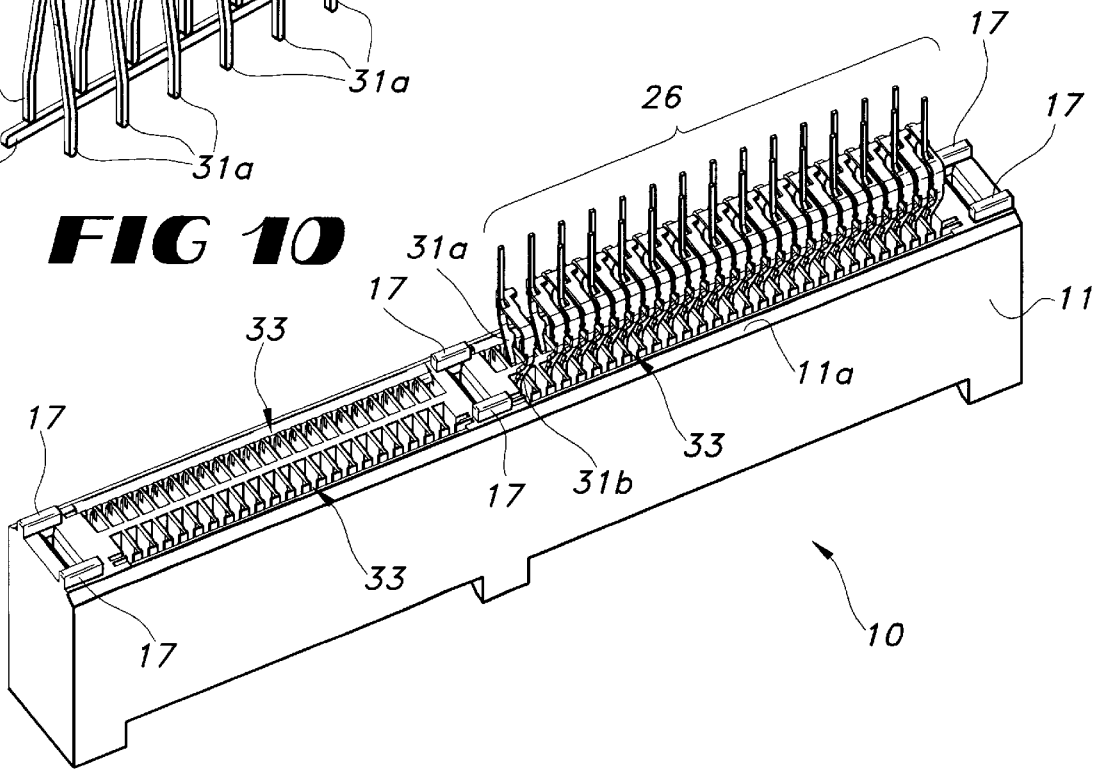
FIG. 17 is a perspective view of the electrical connector of FIG. 1 showing only a portion of the plurality of dual-beam ground contacts having a re-alignment twist α partially inserted into the insulator housing.
Figure 11:
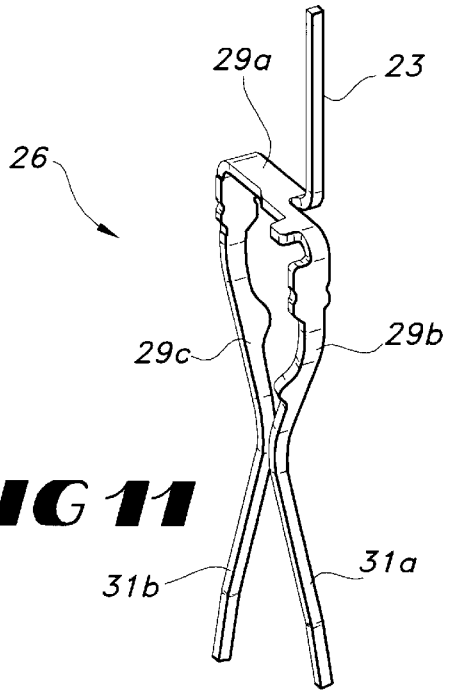
FIG. 11 is a perspective view of one dual-beam electrical contact showing its tips being splayed for pre-loading purposes.
Figure 12:
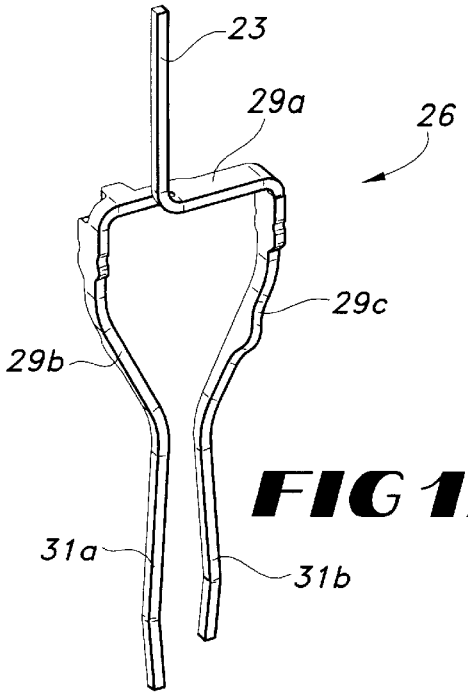
FIG. 12 is another perspective view of the dual-beam electrical contact of FIG. 11.
Figure 15:
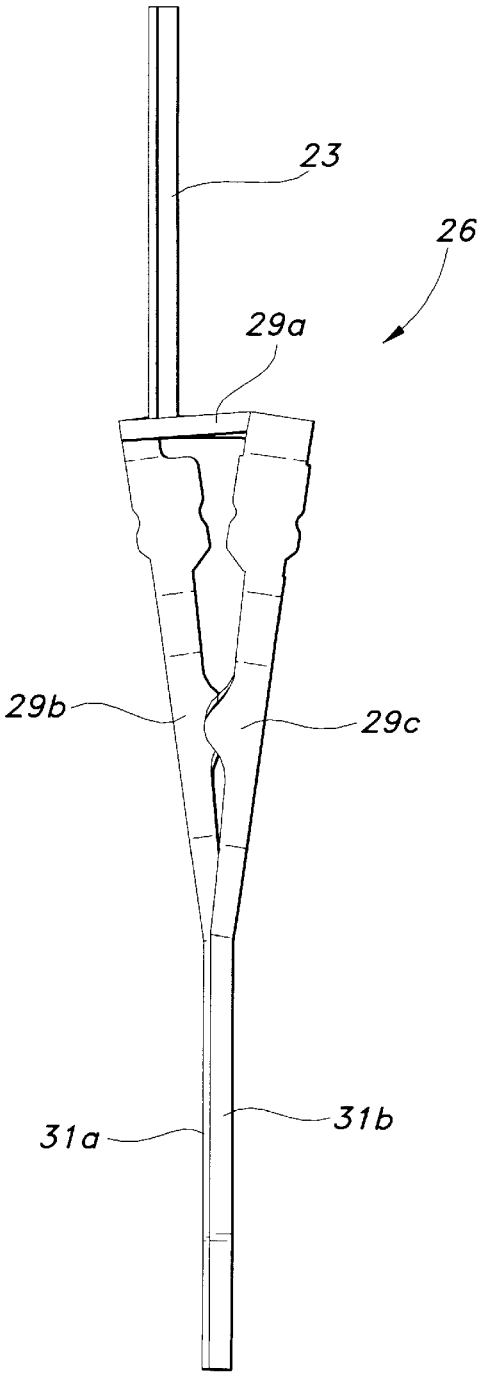
FIG. 15 is a side elevational view of the dual-beam electrical contact of FIG. 11 showing a re-alignment twist of the bottom portion of the contact in order to re-align the contact tips.
Figure 16:
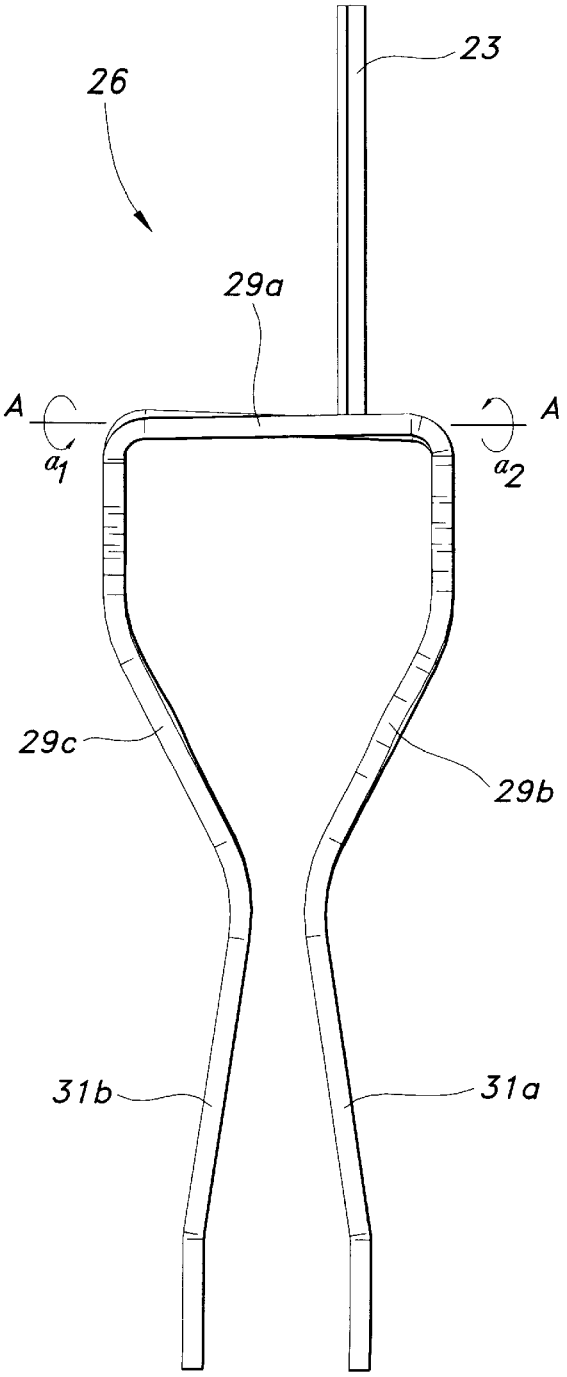
FIG. 16 is a front elevational view of the dual-beam contact shown in FIG. 15 having the re-alignment twist a in the bottom portion of the contact.
Figure 19:
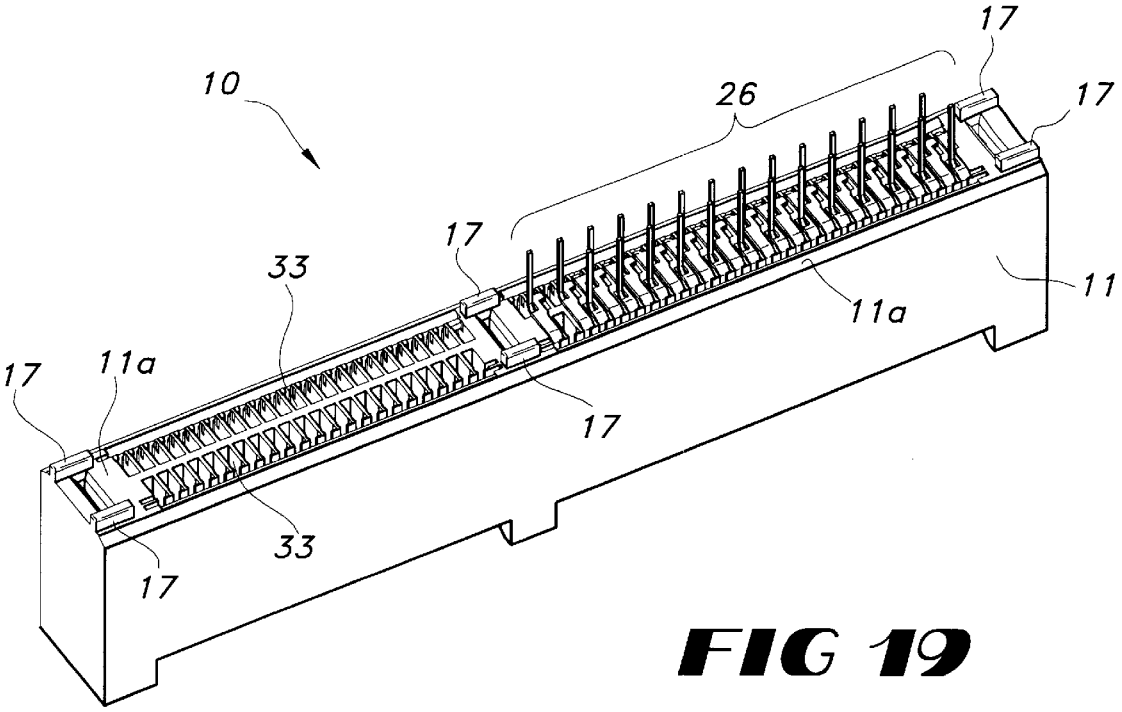
FIG. 19 is a perspective view of the electrical connector of FIG. 17 showing the portion of the plurality of dual-beam ground contacts fully inserted or seated in the insulator housing.

Referring to FIGS. 17 and 19, the tips 31*a* and 31*b* of the plurality of dual-beam ground contacts 26 are bottom loaded into housing 11 through apertures 33. FIG. 17 shows only a portion of the total number of contacts 26 partially loaded while FIG. 19 shows only a portion of the total number of contacts 26 fully seated. In order for the correct tips 31*a* and 31*b* to align with the correct apertures 33, a realignment twist $\alpha$ is added to the bottoming portion 29*a* of the contacts during the stamping or method of manufacture operation, as shown in FIGS. 15 and 16. The realignment twist $\alpha$ occurs about the longitudinal axis A—A of portion 29*a* and is the effective sum of two oppositely oriented twists $\alpha_1$ and $\alpha_2$. The effective angle of the twist is sufficient to bring tips 31*a* and 31*b* into general alignment or into the plane of collar portion 29, as shown in FIGS. 15 and 16, so that they may be gang inserted into the correct apertures 33. Of course, the correct apertures 33 are dependent upon the contact pattern of the connector. The preferred ground contact pattern for the present invention is illustrated throughout the figures, and is best shown in FIG. 17. If the realignment twist a were not introduced into the contacts 26 prior to insertion into housing 11, they would not be inserted correctly, or they would have to be individually inserted. The re-alignment twist a disappears once the contact(s) are fully seated in that portion 29*a* abuttingly engages center bar 34 which in effect straightens portion 29*a* so that it has no twist, allowing tips 31*a* and 31*b* to move to their pre-loaded positions.

What is claimed is:

1. A dual-beam electrical ground contact for use in a card edge connector having an insulator housing, said ground contact comprising:

(a) a generally "U" shaped collar portion including a bottoming portion and first and second opposed converging portions which converge toward one another from said bottoming portion;

(b) a tail portion attached to said bottoming portion;

(c) corresponding first and second diverging tip portions attached to said first and second converging portions, respectively;

(d) said "U" shaped collar portion and said tail portion lying in substantially the same plane;

(e) said first and second tip portions being splayed out of said plane of said collar and tail portions at an angle sufficient for preventing short circuiting with other contacts in said insulator housing once said dual-beam electrical ground contact is fully seated within said insulator housing; and (f) wherein the ends of said bottoming portion of said contact are twisted in opposite directions along the longitudinal axis thereof an amount sufficient to bring said first and second tip portions substantially back into alignment with said plane of said "U" shaped collar portion and said tail portion.

2. The dual-beam electrical ground contact as defined in claim 1, wherein said contact is formed on a elongate carrier strip along with a plurality of other ground contacts for gang insertion into said insulator housing of said card edge connector.

3. A card edge connector, comprising:

(a) an insulator housing having a board-mounting face and a board-receiving face, said board-receiving face including a card slot for receiving a mating edge of a printed circuit board, said board-mounting face including a plurality of contact receiving apertures;

(b) a plurality of dual-beam ground contacts seated within said housing for electrically engaging said mating edge of said printed circuit board, said plurality of ground contacts interconnected by a common carrier strip prior to seating within said housing;

(c) each of said plurality of dual-beam ground contacts including a generally "U" shaped collar portion comprising a bottoming portion and two opposed converging portions attached to said bottoming portion which converge toward one another, each of said plurality of ground contacts further including two opposed diverging tips respectively attached to said converging portions which diverge from one another and a tail portion attached at one end to said bottoming portion, said "U" shaped collar portion and said tail portion lying in substantially the same plane, said tips further including a pre-loaded splay angle relative one another for preventing short circuiting with other contacts in said insulator housing once said plurality of ground contacts are fully seated within said insulator housing; and (d) said bottoming portion including a realignment twist along its longitudinal axis, said realignment twist sufficient to generally reposition said tips back into said plane of said "U" shaped collar portion thereby permitting said tips to be gang inserted into said plurality of contact receiving apertures in said insulator housing.

4. The card edge connector as defined in claim 3, wherein said plurality of contact receiving apertures comprise two rows of apertures extending generally parallel to the longitudinal axis of said insulator housing; said board-mounting face further defining a center bar separating said two rows of apertures, said bottoming portion of each said plurality of ground contacts abuttingly engaging said center bar once said ground contacts are fully seated within said insulator housing thereby effectively removing said realignment twist from said bottoming portion so that said tips return to their pre-loaded positions within said insulator housing.

5. A method of forming and gang inserting a plurality of dual-beam ground contacts into a card edge connector, said connector including an insulator housing having two rows of contact receiving apertures formed in one face separated by a center bar, said method comprising the steps of:

(a) forming said plurality of dual-beam ground contacts on a common carrier strip, each of said plurality of dual-beam ground contacts including a generally "U" shaped collar portion comprising a bottoming portion and two opposed converging portions attached to said bottoming portion which converge toward one another, each of said plurality of ground contacts further including two opposed diverging tips respectively attached to said converging portions which diverge from one another and a tail portion interconnecting said bottoming portion with said carrier strip, said "U" shaped collar portion and said tail portion lying in substantially the same plane;

(b) further fashioning said tips to include a pre-loaded splay angle relative one another for preventing short circuiting with other contacts in said insulator housing once said plurality of ground contacts are fully seated within said insulator housing;

(c) twisting said bottoming portion along its longitudinal axis so as to form a realignment twist sufficient to generally reposition said tips back into said plane of said "U" shaped collar portion;

(d) gang inserting said tips into said two rows of contact receiving apertures; and (e) seating said plurality of ground contacts within said insulator housing wherein said bottoming portion of each said ground contacts abuttingly engages said center bar thereby effectively removing said realignment twist from said bottoming portion so that said tips return to their pre-loaded positions within said insulator housing.

* * * * *